United States Patent [19]

Dola

[11] 4,373,155

[45] Feb. 8, 1983

[54] BRAKE FLUID LEVEL INDICATOR

[75] Inventor: Frank P. Dola, Port Richey, Fla.

[73] Assignee: AMP Incorporated, Harrisburg, Pa.

[21] Appl. No.: 320,646

[22] Filed: Nov. 12, 1981

[51] Int. Cl.[3] ..... G08B 21/00; H01H 3/16

[52] U.S. Cl. ..... 340/623; 73/322.5; 200/84 R

[58] Field of Search ..... 340/623, 624, 625, 59; 200/61.52, 84 R, 84 C; 73/308, 313, 309, 318, 322.5, 321

[56] References Cited

U.S. PATENT DOCUMENTS

| | | | |
|---|---|---|---|
| 2,588,667 | 3/1952 | Stutzman | 73/322.5 X |
| 2,600,659 | 6/1952 | Koch, Jr. | 340/623 X |
| 2,748,378 | 5/1956 | Feins | 340/625 X |
| 3,090,849 | 5/1963 | Coulin | 200/84 R |
| 3,145,727 | 8/1964 | Yamashita | 73/322.5 X |
| 3,291,934 | 12/1966 | Mealy | 73/308 UX |
| 3,309,687 | 3/1967 | Phipps | 340/625 X |
| 3,393,283 | 7/1968 | Lenning | 73/322.5 X |
| 3,543,580 | 12/1970 | McGill | 73/313 |
| 3,545,272 | 12/1970 | McGill | 340/623 X |
| 3,786,464 | 1/1974 | Staempfli | 340/623 |
| 3,812,308 | 5/1974 | Bell et al. | 200/61.52 X |
| 3,866,470 | 2/1975 | Miller | 340/623 X |
| 4,029,920 | 6/1977 | Odell | 340/625 X |
| 4,086,457 | 4/1978 | Niedermeyer | 340/623 X |
| 4,139,750 | 2/1979 | Rau | 200/84 R |
| 4,262,216 | 4/1981 | Johnston | 200/84 R X |
| 4,308,725 | 1/1982 | Chiyoda | 340/623 X |

*Primary Examiner*—John W. Caldwell, Sr.
*Assistant Examiner*—Daniel Myer
*Attorney, Agent, or Firm*—F. Brice Faller

[57] ABSTRACT

Fluid level indicator comprises a float suspended at the apex by wires from the cover of a fluid reservoir. The float has an upper chamber and a lower chamber separated by an intermediate piece having a concave surface facing the apex. A metal ball in the upper chamber rolls into a depression at the center of the surface to bridge two switch contacts when the fluid level is low and the float is suspended by the wires, which are connected to the contacts. The float is top-heavy and rolls over to open the switch when the fluid level is high enough to permit the suspending portion of the wires to slacken.

5 Claims, 3 Drawing Figures

Fig. 1
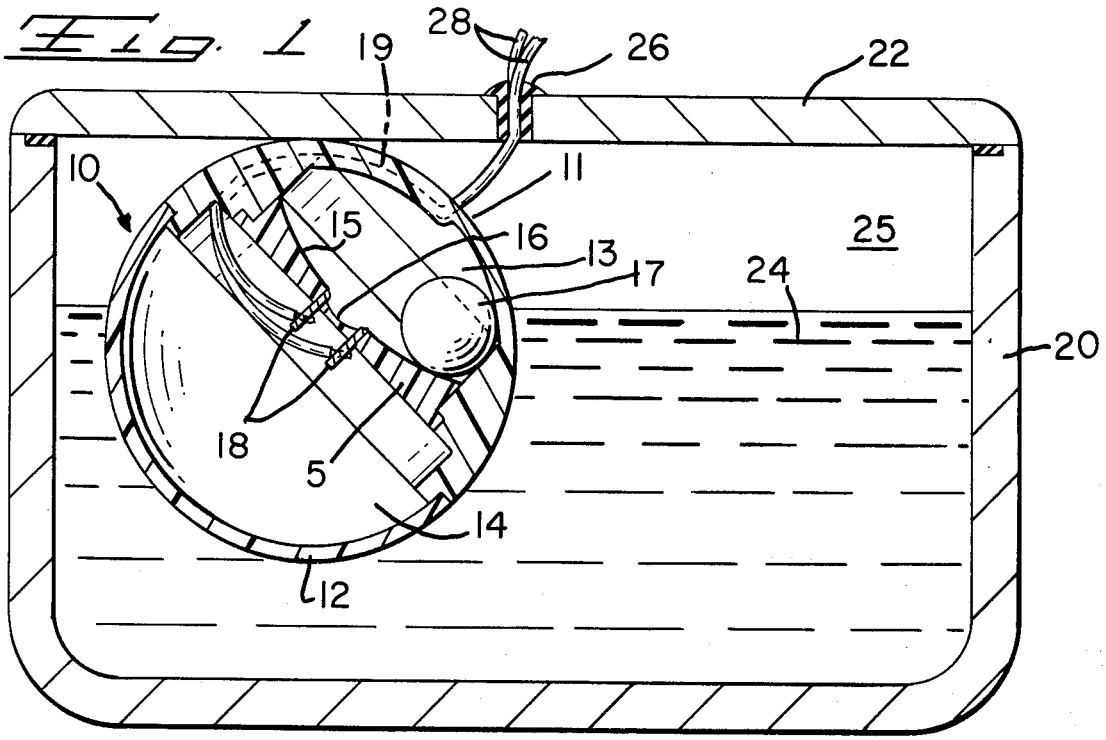
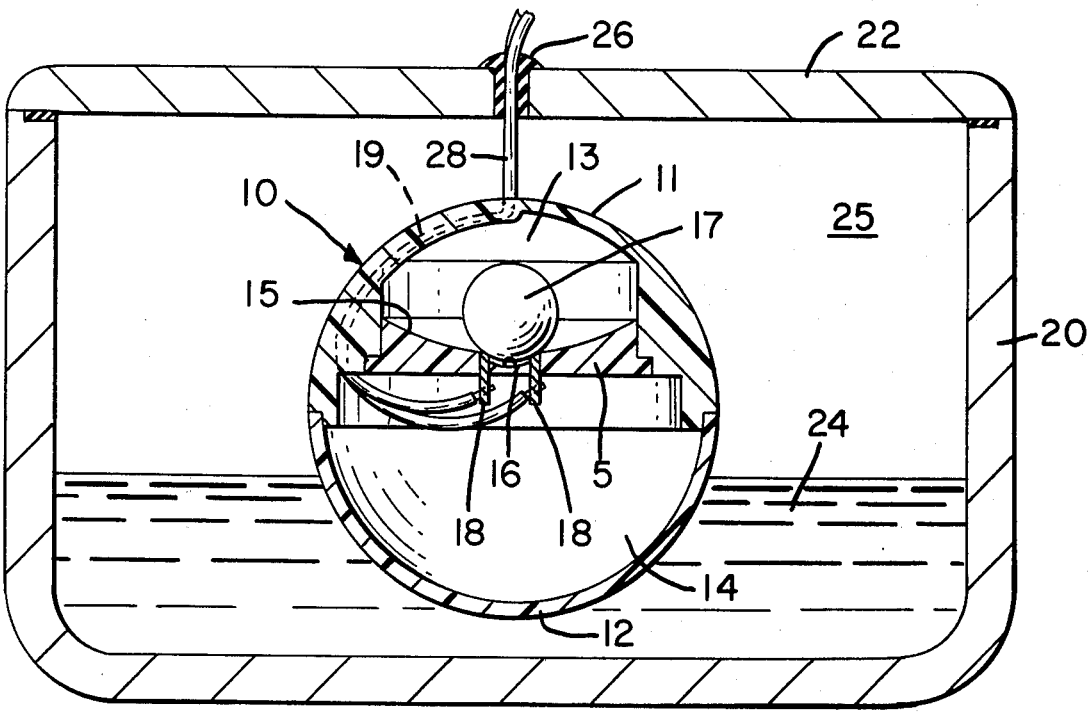
Fig. 2
Fig. 3
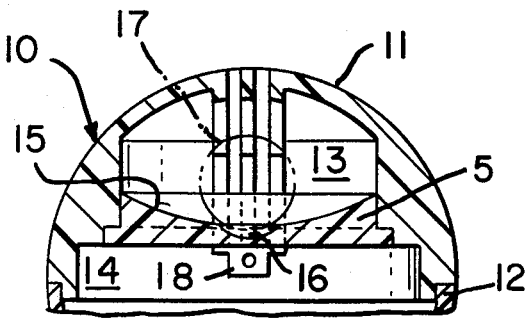

BRAKE FLUID LEVEL INDICATOR

BACKGROUND OF THE INVENTION

The present invention relates to a fluid level sensor or indicator and particularly to a sensor employing a float which closes a switch when fluid reaches a predetermined level.

Prior art brake fluid level indicators generally employ structure fixed to the reservoir containing the fluid whose level is to be indicated. See, e.g., U.S. Pat. No. 2,819,363; this discloses a fluid level indicator having a conductive float member which bridges two electrical contacts when the fluid reaches a certain level. The problem with this and other prior art sensors is complexity and cost of manufacture, and difficulty in retrofitting an existing reservior with an indicator.

SUMMARY OF THE INVENTION

The present invention employs a top-heavy float which is suspended from the cover of the fluid reservior by wires connected to a pair of contacts sealed within the float. The contacts are exposed in the center of a concave surface on which a metal ball rolls to close the circuit in the manner of a mercoid type switch. When fluid level is high, the float floats lopsidedly and the switch is open. When fluid level is low, the float hangs upright by the wires and the switch is closed.

The indicator of the present invention is inexpensive to manufacture and easy to assemble.

The indicator of the present invention may be retrofit to an existing fluid reservoir.

The indicator of the present invention has contacts sealed from vapor and foreign matter.

The indicator of the present invention may be easily adjusted to close the switch at any desired fluid level.

BRIEF DESCRIPTION OF THE DRAWINGS

FIG. 1 is a side sectional view of the float in the reservoir with the switch open.

FIG. 2 is a side sectional view of the float in the reservoir with the switch closed.

FIG. 3 is an end sectional view of the float.

DETAILED DESCRIPTION OF THE PREFERRED EMBODIMENT

Referring to FIG. 1, the float 10 of the present invention is shown canted as it would be with an adequate level of fluid 24 in reservoir 20. The float 10 is comprised of a hollow, hemispherical float bottom or shell 12 and a hollow, hemispherical float top or shell 11 which is profiled to fit tightly against the bottom 12. The pieces 11, 13 are preferably of plastic and are secured together by a plastic cement which also forms a moisture seal. The float top 11 has in intermediate piece 5 profiled to fit tightly therein which is also made of plastic and secured by cement. The intermediate piece 5 separates an upper chamber 13 inside the float top 11 from a lower chamber 14 inside float bottom 12.

The upper chamber 13 contains a metal ball 17 which rolls against concave surface 15. The concave surface 15 has two metal contacts 18 imbedded therethrough on either side of a depression 16 at the center point of the arcuate surface 15 and communicating between lower chamber 14 and upper chamber 13. The contacts have wires 28 attached thereto in the lower chamber 14 which are press fit into channels 19 formed on the inside of the float top 11 as will be more readily apparent in FIG. 3. The wires 28 then pass out through an aperture in the center of the float top 11 at the apex of the upper chamber 13 and thence snugly through an elastomeric seal 26 in the cover 22 on reservoir 20. The float 10 remains canted in reservoir 20 as shown in FIG. 1 as long as the level of fluid 24 is high since the float 10 is top-heavy and it tends to roll over.

FIG. 2 shows the float 10 upright as it would be when the level of fluid 24 is low enough that the float is suspended by wires 28 from the reservoir cover 22. When the fluid 24 reaches this level, the metal ball 17 rolls into the depression 16 in concave surface 15 and bridges the depression 16 to electrically connect the contacts 18, which closes a circuit to activate a remote indicator light or other electrical warning device. Since the length of wires between the float and the cover 22 may be varied by pulling the wires through seal 26, the fluid level at which the float 10 is upright and the contacts 18 are bridged may be readily adjusted as desired.

FIG. 3 is an end sectional view of the float 11 top in the "switched closed" position of FIG. 2. Note the channels 19 which are molded in the float top 11 to receive the wires 28. This arrangement facilitates easy assembly of the float 10 and anchors the wires 28 firmly in the float 10 without clips, cement, or other retaining means. The contacts 18 are press fit through molded openings in the intermediate piece 5.

The above description is exemplary and not intended to limit the scope of the claims which follow.

I claim:

1. A fluid level indicator of the type comprising a fluid reservoir having a reservoir cover thereon and a float contained in said reservoir, said float being lighter than an equal volume of the fluid whose level is to be indicated, said indicator being characterized in that said indicator further has means for suspending said float from the reservoir cover, said suspending means limiting the downward travel of said float when the fluid level drops, said suspending means defining the apex of the float at the point of attachment thereto, said float being top-heavy toward said apex whereby said apex tends to submerge when the float is floating, said float has an upper chamber and a lower chamber therein, said chambers being separated by an intermediate piece having a concave surface facing said upper chamber, said concave surface having a pair of metal contacts embedded in the center thereof flushly with said surface, said surface having a depression therein between said contacts, said contacts communicating with said lower chamber and having wires attached thereat, said wires being connected to warning means remote from said reservoir, said upper chamber having a metal ball therein, whereby, said float hangs upright on said suspending means and said metal ball rests in said depression and bridges said contacts when said fluid level is low, thereby activating said remote warning means, and said float tends to roll over so that said ball rolls out of said depression when said fluid level is high.

2. The fluid level indicator of claim 1 wherein said wires form said suspension means.

3. The fluid level indicator of claim 1 wherein said float is a spherical member.

4. The fluid level indicator of claim 3 wherein said float comprises a hemispherical top piece and a hemispherical bottom piece which are fit together sealingly, said intermediate piece being fixed in said top.

5. The fluid level indicator of claim 3 wherein said wires form said suspension means, said hemispherical top having channels molded therein, said channels being sized to receive said wires in an interference fit, said channels extending to an aperture in said top at said apex, whereby said wires are press fit into said channels and extended through said aperture.

* * * * *